United States Patent [19]

Mowbray et al.

[11] 4,392,466

[45] Jul. 12, 1983

[54] FUEL SYSTEM FOR ENGINES

[75] Inventors: Dorian F. Mowbray, Burnham; Boaz A. Jarrett, London, both of England

[73] Assignee: Lucas Industries Limited, Birmingham, England

[21] Appl. No.: 386,273

[22] Filed: Jun. 8, 1982

Related U.S. Application Data

[63] Continuation of Ser. No. 111,469, Jan. 11, 1980, abandoned.

[30] Foreign Application Priority Data

Oct. 5, 1979 [GB] United Kingdom ..... 7934620

[51] Int. Cl.[3] ..... F02B 3/00; F02M 41/00

[52] U.S. Cl. ..... 123/299; 123/179 L; 123/451; 123/495

[58] Field of Search ..... 123/495, 451, 445, 446, 123/497, 498, 499, 300, 299, 179 L; 417/426, 427, 286, 302; 137/567, 565.1

[56] References Cited

U.S. PATENT DOCUMENTS

| | | | |
|---|---|---|---|
| 1,194,567 | 8/1916 | Stoltz | 123/510 |
| 1,365,301 | 1/1921 | Brooks | 123/300 |
| 4,224,903 | 9/1980 | Mowbray | 123/300 |
| 4,280,464 | 7/1981 | Kanai | 123/499 |

*Primary Examiner*—Ira S. Lazarus
*Assistant Examiner*—Carl S. Miller

[57] ABSTRACT

A fuel system for supplying fuel to a pair of injection nozzles of an engine comprises a pair of pumps which can only deliver half the maximum amount of fuel which may be required. Each pump supplies fuel to a respective nozzle when the fuel required is less than half and the system includes a pair of valves which are operated to allow both pumps to deliver fuel through one nozzle when more than half the maximum amount of fuel is required, the pumps then being operated at twice the previous rate to supply fuel to the nozzles in turn.

3 Claims, 2 Drawing Figures

FUEL SYSTEM FOR ENGINES

This is a continuation of application Ser. No. 111,469, filed Jan. 11, 1980, now abandoned.

This invention relates to fuel systems for supplying fuel to compression ignition engines particularly of the so called direct injection type, the system including electromagnetically operable fuel pumps.

When fuel is injected directly into a combustion chamber formed by the cylinder of a compression ignition engine it is necessary to supply the fuel at a higher pressure than in the case of an engine of the indirect injection type where the fuel is supplied to a combustion chamber which is connected by a passage to the engine cylinder. Moreover, with the direct injection type of engine it is necessary to use a nozzle of the inwardly opening type instead of the outwardly opening type which is possible with indirect injection engines.

A pump operated by an electromagnetic device is described in the specification of British Patent Application 7912311 and as shown and described in that specification, includes a nozzle of the outwardly opening type which is incorporated in the body of the pump. If a higher pressure is required it is clearly necessary to increase the size of the electromagnetic device so that for a given volume of fuel delivered a higher fuel pressure can be developed. As a result the size and weight of the pump is increased which makes it difficult to accommodate a number of such pumps on an engine and also adds substantially to the cost of the fuel system.

If however the stroke of the pump is reduced the air gap or gaps in the magnetic circuit of the device can be reduced and hence the pump for the same size of piston and device and for substantially the same actuating current supplied to the device, can develop an increased pressure. The increase in pressure which can be obtained is sufficient to enable the pump to be used to supply fuel through an inwardly opening type of nozzle and therefore to a direct injection engine. The quantity of fuel which can be delivered is of course reduced and in order to supply more fuel than can be supplied by one pump, a further pump must be provided. Alternatively the size of the plunger can be reduced which will have the effect of increasing the pressure but again reducing the volume of fuel supplied. However, two nozzles can still be supplied by two pumps since in a four stroke engine each nozzle supplies fuel once per two revolutions of the engine. Two pumps can then be utilised for supplying fuel to two nozzles with both pumps being utilised when the amount of fuel to be supplied through each nozzle exceeds the amount of fuel which can by pumped by one pump.

According to the invention a fuel system for supplying fuel to a compression ignition engine comprises nozzles which are mounted on the associated engine to direct fuel into the combustion chambers of the engine respectively, electromagnetically operable pumps for supplying fuel under pressure to the nozzles respectively, and valve means associated with the pumps respectively said valve means being operable so that when fuel is supplied to a particular nozzle the fuel which is supplied to that nozzle is derived from the pump associated with that nozzle and can be supplemented by fuel supplied by a pump associated with another of said nozzles.

An example of a fuel system in accordance with the invention will now be described with reference to the accompanying drawings in which.

Figure 1:
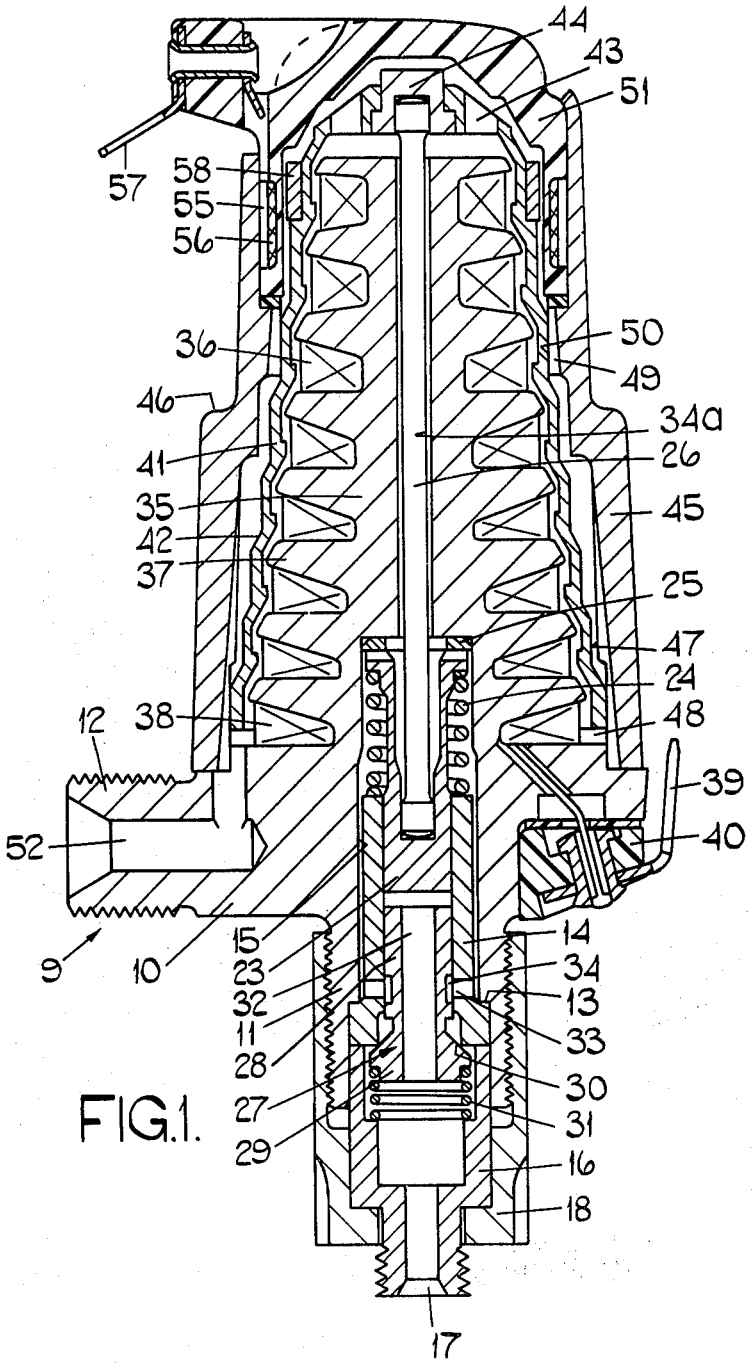
FIG. 1 is a sectional side elevation of a pump.

Referring to FIG. 1 of the drawings an electromagnetically operable pump 9 is provided and which comprises a housing 10 which is of generally cylindrical form. The housing 10 is provided with a first boss portion 11 which extends axially from the housing, and a second boss portion 12 which extends laterally from the housing. Both boss portions are provided with peripheral screw threads.

The first boss portion is of hollow form and defines an internal step 13 against which is located the flange of a pump barrel 14. The barrel extends with clearance within a cylindrical chamber 15 defined within the housing and the flange of the pump barrel is held in engagement with the step 13 by means of a cup-shaped member 16 which defines an outlet 17. The cup-shaped member is held in engagement with the flange on the barrel by means of a retaining nut 18 which is in screw thread engagement with the boss portion 11.

Located within the bore defined in the pump barrel is a pumping plunger 23 and this extends from the end of the barrel and has a flange between which and the end of the pump barrel is located a coiled compression spring 24. The flanged end of the pumping plunger is provided with radially extending grooves and the movement of the pumping plunger under the action of the spring 24 is limited by abutment of the pumping plunger with a stop ring 25 which is located against a step defined in the housing. Moreover, the pumping plunger is provided with a recess which receives the end of a push rod 26.

Fuel is supplied to the space defined within the housing in a manner which will be explained. This fuel is under a small pressure and during outward movement of the pumping plunger under the action of the spring 24, fuel is drawn into the chamber defined by the pump barrel and it flows by way of a non-return valve so that when the plunger is moved inwardly the non-return valve remains closed and the fuel is displaced through the outlet 17.

The non-return valve comprises a valve member 27 having a shank portion 28 which is slidably supported within the bore in the pump barrel. The valve member also includes a valve head 29 which is of larger diameter than the shank portion and this in the closed position of the valve member, engages with an annular edge 30 defined at the end of an enlarged portion of the bore in the barrel. The valve member is urged to the closed position by a compression spring 31 and extending through the valve member is a bore 32. In addition the barrel 14 is provided adjacent the flange, with a pair of radially extending ports 33 which at their outer ends communicate with the space defined between the outer periphery of the barrel and the wall 15 of the chamber formed in the housing. At their inner ends, the ports communicate with a circumferential groove 34 formed in the periphery of the shank 28 of the valve member. The shank 28 is of such a length that towards the end of the stroke of the pumping plunger the latter will engage with the shank and lift the valve member against the action of the spring 31. When this occurs delivery of fuel through the outlet 17 ceases and the remaining volume of fuel displaced by the pumping plunger flows through the ports 33.

When the pumping plunger is returned under the action of the spring 24, the valve member 27 remains in a position such that the ports 33 are in communication with the bore and the head 29 lifted from the edge 30. The reason for this is that fuel under pressure from the aforesaid chamber acts on the valve head and flow of fuel occurs into the bore occupied by the pumping plunger. This flow of fuel continues until movement of the plunger is halted either by the stop ring or earlier as will be explained. As soon as the movement of the plunger is halted no further fuel can flow into the bore and the fluid pressures acting on the valve member are equalised. As a result the valve member moves under the action of the spring 31 until the head engages the aforesaid edge and the communication of the ports with the bore is broken.

In order to effect movement of the pumping plunger against the action of the spring 24 and in a direction to pump fuel through the outlet 17, an electromagnetic device is provided which imparts its movement to the plunger by way of a push rod 26 which extends through a bore 34*a* formed in a core member 35. The core member is formed from magnetisable material and conveniently is integral with the housing. It may however be formed as a separate part in which case the housing need not be of magnetisable material. The core member is of generally truncated conical configuration and is provided with a plurality of circumferentially extending grooves 36. These grooves define circumferentially extending ribs 37 and the further a particular rib is from the housing 10, the smaller is its diameter. Moreover, the width of the grooves 36 increases as the distance from the housing 10 increases. The outer surfaces of the ribs are inclined to the axis of the core member and each groove accommodates a winding 38. The windings which are multi-turn windings, are conveniently connected in series in such a fashion that when electric current is passed through the windings the direction of current flow in adjacent windings is in the opposite direction. In this manner adjacent ribs 37 when electric current passes through the windings, will be magnetised to opposite magnetic polarity. Conveniently one end of the series connected windings is connected to the core member whilst the other end is connected to a terminal 39 which is carried by an electrically insulating block 40 which is secured to the housing.

Surrounding the core member is an armature 41 which is also formed from magnetisable material but has a thin section. The armature 41 can be regarded as being composed of a number of hoops of reducing diameter which are connected together by inclined portions such as shown at 42. The internal faces of the inclined portions lie substantially parallel to the aforesaid faces of the ribs 37. The armature is of cup-shaped form and the base wall is provided with a pair of apertures 43 and a central aperture which receives a plug 44 in which is located the remote end of the push rod 26. When the windings are energised the armature will move downwardly to reduce the reluctance of the air gaps between the ribs and the inclined portions 42 of the armature, and in so doing movement will be imparted to the pumping plunger 23.

Surrounding the armature is a hollow cover 45 which is formed from non-magnetic material conveniently as a die-casting from a zinc based alloy. For convenience the outer peripheral surface of the cover has a step 46 and the sides of the cover taper to permit its withdrawal from the die cavity. The internal surface is also of stepped form and is shaped to support the armature for axial movement. The end portion of the cover, that is to say the portion extending between the external step, and the housing 10, is formed with four internal ribs 47 and defined between these ribs are recesses. As explained in order to permit the casting to be removed from the die the internal surfaces are tapered and after removal from the die cavity the ribs 47 are machined so as to define cylindrical surfaces which extend parallel to the axis of the core member. In this manner four bearing surfaces 48 are formed which are engaged by the armature at its wider end.

The cover is provided with four further ribs 49 and again when manufactured these are tapered. The internal surfaces of the ribs are machined to provide cylindrical bearing surfaces which engage with complementary surfaces of the armature nearer the narrower end thereof. The open end of the cover is closed by a non-metallic closure member 51 which is of generally cup-shaped form. The wall of the closure member extends within the cover and the end portion engages a sealing ring located against a step defined adjacent the ribs 49. The closure member 51 is retained by suitable deformation of the end portion of the cover and the space defined within the cover is connected to a fuel inlet 52 formed in the boss 12. In use, fuel can flow upwardly on the inside or the outside of the armature through the apertures 43 if it has flowed upwardly on the outside of the armature and down the bore 34*a* to the bore 50 in the housing. Thus cooling of the windings is achieved by the fuel.

The skirt of the end closure 51 is provided in its external peripheral surface, with a circumferential groove 55. In the groove there is located a single layer electrical winding 56 the ends of which are connected to terminals 57 carried by the end closure. The armature 41 mounts a ring 58 formed from electrically conductive material and when alternating current is supplied to the winding 56 eddy currents will flow in the ring 58 which will vary the inductance of the winding 56. The extent of variation of the inductance depends on the length of the portion of the ring 58 which is located within the winding and since the ring is mounted on the armature, the inductance value provides a measure of the axial position of the armature.

In use, if it is required to deliver the maximum volume of fuel then the pumping plunger 23 is allowed to move its maximum extent under the action of the spring 24. The windings may be de-energised immediately after delivery of fuel has taken place or they can be de-energised at some time before the next delivery of fuel is required, providing sufficient time is allowed for the fuel to flow into the bore in the pump barrel. If it is required that the pump should deliver less than its maximum volume of fuel then the return motion of the armature under the action of the spring 24 must be halted at some intermediate position. The transducer defined by the winding 56 and ring 58 provides an indication of the position of the pumping plunger and using the signal obtained from the transducer it is possible to partly energise the windings when the plunger has moved the required amount. Such partial energisation of the windings creates sufficient force to hold the armature against the action of the spring 24 but it does not pressurise the fuel in the outlet 17 by any significant extent. When delivery of fuel is required the windings are fully energised and flow of fuel takes place from the outlet until the valve head 29 is lifted from the seating. The filling of the bore can take place at any time after the termination of fuel delivery and before the next delivery of fuel is required. It must be remembered however that the filling of the bore with fuel does take a finite time and therefore if it is decided to fill immediately before delivery of fuel is required sufficient time must be allowed for the filling to take place.

Figure 2:
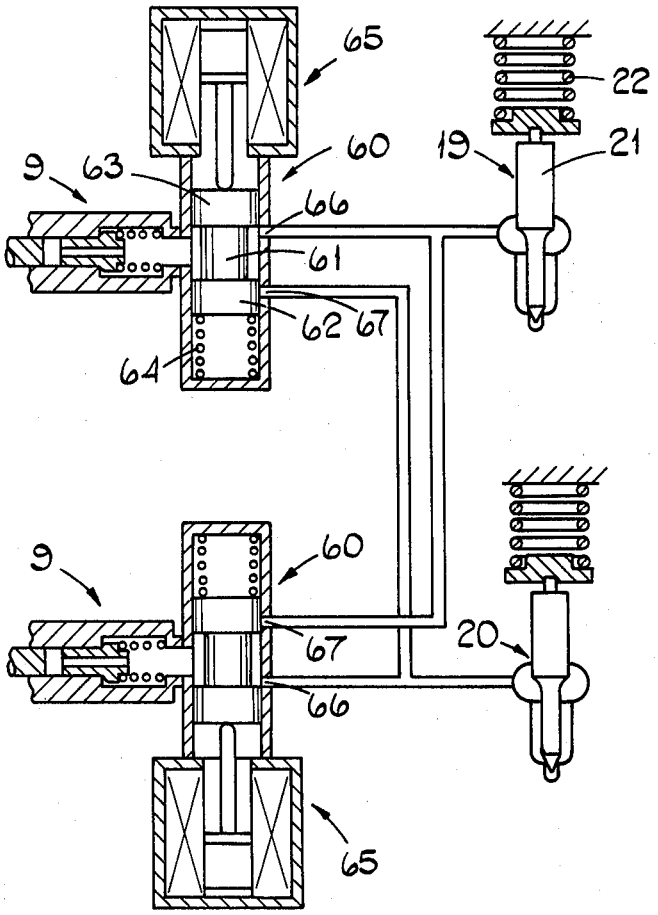
FIG. 2 is a diagrammatic illustration showing a fuel system for an engine of four cylinders.

Turning now to FIG. 2 two nozzles 19, 20 are illustrated, these being two of the fuel injection nozzles of a four cylinder direct injection compression ignition engine. The nozzles are mounted on the engine so as to direct fuel into combustion spaces defined by the cylinders of the engine. Each nozzle is of the inwardly opening type and includes a valve member 21 which is biased into contact with a seating by means of a spring 22.

Associated with each nozzle is a pump 9 of the type described with reference to FIG. 1 and associated with each of those pumps is a change over valve 60. Each change over valve comprises a spool 61 having a pair of lands 62, 63. The spools 61 are biased by compression springs 64 and can be moved in the opposite direction against the action of the springs by means of solenoid operators 65.

In the de-energised condition of the operator 65 the setting of the spool is such that the outlet 17 of the pump is connected to a port 66 which is directly connected to the associated nozzle 19 or 20. Thus when the upper pump 9 is actuated fuel will be supplied to the nozzle 19 and when the lower pump 9 is actuated fuel will be supplied to the nozzle 20. As previously explained in order to deliver fuel at a sufficiently high pressure the output of fuel from in the pumps 9 must be reduced and hence as so far described, the pumps would not be able to supply sufficient fuel for the full load range of the engine. In order to overcome this difficulty each change over valve has a connection to the other nozzle of the pair and considering the upper valve 60 it has a port 67 which is connected to a point intermediate the port 66 of the other change over valve and the associated nozzle 20. Similarly the lower change over valve has a port 67 which is connected to a point intermediate the port 66 and the nozzle 19.

In operation when it is required to supply fuel to the nozzle 19 in a quantity which is greater than that which can be supplied by the upper pump 9, the operator 65 of the lower change over valve is energised and this has the effect of breaking the communication between the port 66 thereof, and the lower pump and establishing communication between the port 67 and the upper pump. Both pumps are then actuated and the lower pump 9 supplies fuel directly to the nozzle 19 as also does the lower pump 9. When fuel is required to be supplied to the nozzle 20 then from the condition just described, the operator 65 of the lower change over valve is de-energised and that of the upper change over valve energised and fuel is then fed directly to the nozzle 20 on the lower pump 9 and also from the upper pump 9 by way of the port 67 of the associated change over valve. Thus when the amount of fuel required to be supplied to the nozzles is less than or just equal to that which can be delivered by the pumps, each pump operates once every two revolutions of the engine however when the quantity of fuel is greater than that which can be supplied by one pump, each pump is operated once per revolution of its engine.

The supply of electrical power to the solenoid operators 65 is controlled by a logic system which forms part of the associated fuel control system and which is only brought into effect when the quantity of fuel required to be supplied to the nozzles is greater than that which can be supplied by a single pump.

It is desirable that the pumps should be mounted as close to the respective change over valves as possible. They can be attached directly to the housings of the change over valves or by short lengths of high pressure pipe.

We claim:

1. A direct injection type fuel system for supplying fuel to a compression ignition engine comprising inwardly opening type nozzles which are mounted on the associated engine to direct fuel into the combustion chambers of the engine respectively, electromagnetically operable pumps for supplying fuel under pressure to the nozzles respectively, and change over valves associated with the pumps respectively, each valve having a connection to the associated pump and a pair of outlets, first conduit means connecting a first one of said outlets to the associated nozzle and second conduit means connecting said first conduit means to the second one of the pair of outlets of another of said change over valves, said valves being operable so that when fuel is supplied to a particular nozzle the fuel which is supplied to that nozzle is derived from the pump associated with that nozzle when the fuel required is equal to or less than one-half the maximum amount required by that nozzle and can be supplemented by fuel supplied to that nozzle simultaneously with the fuel supplied thereto by the pump associated with that nozzle by a pump associated with another of said nozzles when the fuel required is greater than one-half the maximum amount required by that nozzle.

2. A system according to claim 1, wherein each change over valve includes a spool member, resilient means biasing the spool member to one position in which one of said outlets is out of communication with the outlet of the associated pump, and a solenoid operator for moving the spool to an alternative position against the action of said resilient means so that the other of said outlets is out of communication with said outlet of the associated pump.

3. A system according to claim 2, wherein said one outlet is in communication with the outlet of the associated pump in the alternative position of said spool.

* * * * *